US011953258B2

(12) United States Patent
Gochika et al.

(10) Patent No.: US 11,953,258 B2
(45) Date of Patent: Apr. 9, 2024

(54) SIDE ACCESS PANEL FOR AN APPLIANCE

(71) Applicant: WHIRLPOOL CORPORATION, Benton Harbor, MI (US)

(72) Inventors: Koteswara Rao Gochika, Pune (IN); Narendra A. Kapure, Pune (IN); Manjunathraddi Navalgund, Pune (IN); Manoj T. Sambrekar, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 18/108,930

(22) Filed: Feb. 13, 2023

(65) Prior Publication Data

US 2023/0194145 A1 Jun. 22, 2023

Related U.S. Application Data

(63) Continuation of application No. 17/480,632, filed on Sep. 21, 2021, now Pat. No. 11,578,908, which is a continuation of application No. 16/729,832, filed on Dec. 30, 2019, now Pat. No. 11,156,396.

(51) Int. Cl.

| | |
|---|---|
| ***F25D 23/00*** | (2006.01) |
| ***F25D 23/02*** | (2006.01) |
| ***F25D 23/06*** | (2006.01) |

(52) U.S. Cl.

CPC ..... *F25D 23/006* (2013.01); *F25D 23/025* (2013.01); *F25D 23/062* (2013.01); *F25D 2201/14* (2013.01)

(58) Field of Classification Search

CPC ..... F25D 23/00; F25D 23/006; F25D 23/062; F25D 23/063; F25D 23/065; F25D 23/025; F25D 19/00; F25D 2201/14; F25D 2323/00267; F25D 2323/00277

See application file for complete search history.

(56) References Cited

U.S. PATENT DOCUMENTS

| | | | |
|---|---|---|---|
| 2,112,599 | A | 3/1938 | Heitman |
| 4,151,726 | A | 5/1979 | Schlueter |
| 6,629,429 | B1 | 10/2003 | Kawamura et al. |
| 9,939,189 | B2 | 4/2018 | Koo et al. |
| 10,126,039 | B2 | 11/2018 | Boehringer et al. |
| 10,174,988 | B2 | 1/2019 | Heinrich et al. |
| 10,563,901 | B2 | 2/2020 | Boehringer et al. |
| 11,156,396 | B2 | 10/2021 | Gochika et al. |
| 2005/0213294 | A1 | 9/2005 | Lambert et al. |
| 2019/0162463 | A1 | 5/2019 | Chen et al. |

(Continued)

FOREIGN PATENT DOCUMENTS

| | | | |
|---|---|---|---|
| CN | 109554898 | A | 4/2019 |
| EP | 2878905 | A1 | 6/2015 |

(Continued)

*Primary Examiner* — Andrew M Roersma

(74) *Attorney, Agent, or Firm* — Price Heneveld LLP

(57) ABSTRACT

A refrigerating appliance includes a refrigerating cabinet that has an outer wrapper. A machine compartment is disposed proximate a rear bottom of the refrigerating cabinet. The machine compartment is defined by selectively removable side panels, an inner curved surface of the outer wrapper, and a bottom support plate. A controller is disposed within the machine compartment. Reinforcement segments extend from a planar extent of the outer wrapper to a lip of the bottom support plate.

13 Claims, 10 Drawing Sheets

(56) References Cited

U.S. PATENT DOCUMENTS

| | | | |
|---|---|---|---|
| 2019/0184506 | A1 | 6/2019 | Conde Zelocuatecatl |
| 2020/0141629 | A1 | 5/2020 | Seo |
| 2021/0199366 | A1 | 7/2021 | Gochika et al. |

FOREIGN PATENT DOCUMENTS

| | | | | | |
|---|---|---|---|---|---|
| JP | H-08200934 | A | * | 8/1996 | ..... F25D 23/06 |
| JP | 2007017044 | A | | 1/2007 | |
| KR | 20160086141 | A | | 7/2016 | |
| WO | 2009041778 | A2 | | 4/2009 | |
| WO | WO-2010092626 | A1 | * | 8/2010 | ..... F25D 23/00 |
| WO | 2012113630 | A2 | | 8/2012 | |
| WO | 2014201892 | A1 | | 12/2014 | |
| WO | 2017145691 | A1 | | 8/2017 | |
| WO | WO-2018034665 | A1 | * | 2/2018 | ..... F25D 23/006 |
| WO | 2018164661 | A1 | | 9/2018 | |
| WO | WO-2020002452 | A1 | * | 1/2020 | ..... F25D 23/065 |

* cited by examiner

SIDE ACCESS PANEL FOR AN APPLIANCE

CROSS-REFERENCE TO RELATED APPLICATION

The present application is a continuation of U.S. patent application Ser. No. 17/480,632, filed on Sep. 21, 2021, now U.S. Pat. No. 11,578,908, and entitled "SIDE ACCESS PANEL FOR AN APPLIANCE," which is a continuation of U.S. patent application Ser. No. 16/729,832, filed on Dec. 30, 2019, now U.S. Pat. No. 11,156,396, and entitled "SIDE ACCESS PANEL FOR AN APPLIANCE," the entire disclosures of which are incorporated herein by reference in their entirety.

BACKGROUND OF THE DISCLOSURE

The present disclosure generally relates to an appliance, and more specifically, to a side access panel for an appliance.

SUMMARY OF THE DISCLOSURE

According to one aspect of the present disclosure, a refrigerating appliance includes a refrigerating cabinet that has an outer wrapper. A machine compartment is disposed proximate a rear bottom of the refrigerating cabinet. The machine compartment is defined by selectively removable side panels, an inner curved surface of the outer wrapper, and a bottom support plate. A controller is disposed within the machine compartment. Reinforcement segments extend from a planar extent of the outer wrapper to a lip of the bottom support plate.

According to another aspect of the present disclosure, an appliance cabinet includes an outer wrapper that encloses an inner liner. The outer wrapper defines a machine compartment. First and second support members extend from a rear most portion of the outer wrapper to the machine compartment. First and second selectively removable side access panels are removably coupled to the outer wrapper. Each of the first and second selectively removable side access panels include a body with support ribs, an arcuate offset flange, and a linear flange that extends orthogonally from the body.

According to yet another aspect of the present disclosure, appliance cabinet includes an outer wrapper and a base that includes a first rail and a second rail. The first rail and the second rail extend beyond a rear wall of the outer wrapper. A machine compartment is disposed between the outer wrapper and the first and second rails. A first side access panel is disposed between the outer wrapper and the first rail, and a second side access panel is disposed between the outer wrapper and the second rail.

These and other features, advantages, and objects of the present disclosure will be further understood and appreciated by those skilled in the art by reference to the following specification, claims, and appended drawings.

Figure 1:
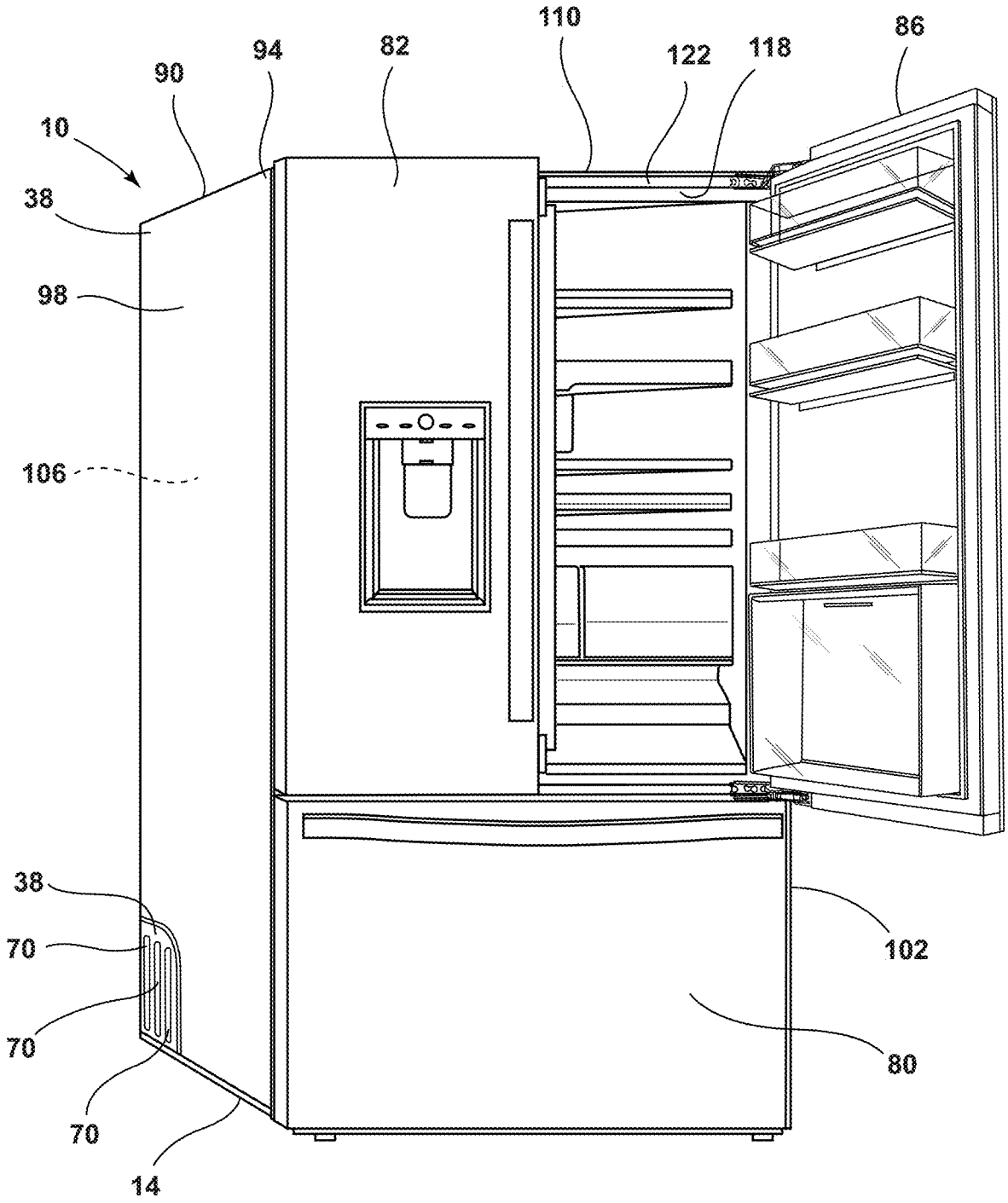
FIG. 1 is a front side perspective view of an appliance of the present disclosure.

The components in the figures are not necessarily to scale, emphasis instead being placed upon illustrating the principles described herein.

DETAILED DESCRIPTION

The present illustrated embodiments reside primarily in combinations of apparatus components related to a side access panel for an appliance. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Typically, a conventional appliance will define a machine compartment that is covered by a rear surface of the conventional appliance. In order to service machine components within the machine compartment, the rear surface of the conventional appliance must be removed, and the appliance must be at least partially rotated so as to access the machine compartment. The side access panel described herein is advantageously, removably coupled to the side of an appliance, such that the machine compartment may be accessed without rotating the appliance.

Referring to FIGS. 1-10, reference numeral 10 generally designates an appliance. The appliance 10 includes a base 14 and a wrapper 18 coupled to the base 14. The wrapper 18 has a rear planar surface 22 and a curved surface 26. A machine compartment 30 is defined by the base 14 and the curved surface 26 of the wrapper 18. An attachment feature 34 is operably coupled to the curved surface 26 of the wrapper 18. A side access panel 38 is operably coupled to the attachment feature 34. The side access panel 38 includes a brim 42 that extends toward the machine compartment 30 and a base edge 46 proximate to the base 14. The side access panel 38 also includes an arcuate portion 50 that defines apertures 54. The arcuate portion 50 is operably coupled to the attachment feature 34. A central body 58 of the side access panel 38 has an interior surface 62 and an exterior surface 66. The interior surface 62 defines support ribs 70. A controller 74 is operably coupled to the interior surface 62 of the side access panel 38.

Referring to FIGS. 1-4, the appliance 10 is illustrated as a refrigerating appliance, but it is also contemplated that the side access panel 38 described herein may be used with a variety of appliances. The appliance 10 is illustrated as a French door style refrigerator with a bottom-mounted drawer 80. In addition to the bottom-mounted drawer 80, the appliance 10 includes first and second doors 82, 86 hingedly coupled to a body 88 of the appliance 10. As described herein, the term body 88 may include similar features as the wrapper 18, such as the rear planar surface 22 and the curved surface 26. Additionally or alternatively, the body 88 can be defined by a cabinet 90 which is covered by an outer casing 94, which includes first and second side panels 98, 102, a rear panel 106, and a top panel 110. Each panel 98, 102, 106, 110 may be formed from a metallic material, plastic material, or other materials typically used to form the outer casing 94 of an appliance 10.

Figure 2:
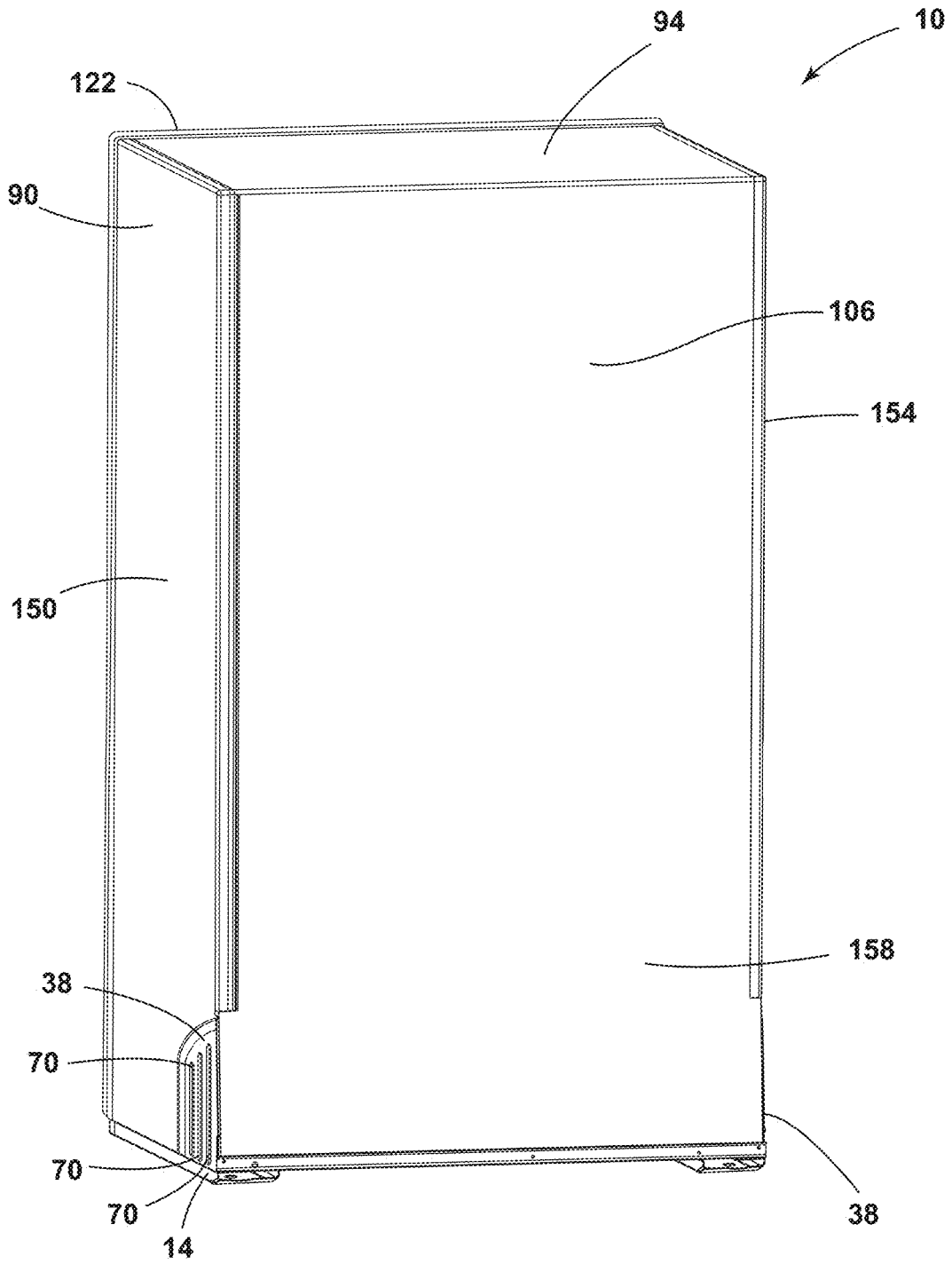
FIG. 2 is a rear side perspective view of the appliance of FIG. 1.

With reference to the construction illustrated in FIGS. 1 and 2, the outer casing 94 covers an insulated structure 114, which includes the wrapper 18 and a liner 118 to which the wrapper 18 is coupled. Stated differently, the insulated structure 114 is defined by the liner 118 and the wrapper 18. When forming the insulated structure 114, the liner 118 and the wrapper 18 are typically coupled to a trim breaker 122 to define an insulating cavity 126 therebetween in which one or more insulation materials 130 may be disposed. It is generally contemplated that the insulation materials 130 may be a glass type material, a carbon-based powder, silicone oxide-based materials, insulating gases, and other standard insulation materials 130 known in the art. The insulation materials 130 substantially fill the insulating cavity 126 to form a substantially continuous layer between the liner 118 and the wrapper 18. The insulating cavity 126 is evacuated by a vacuum to further define the insulated structure 114 as a vacuum insulated structure 114.

It is generally contemplated that the wrapper 18 and the liner 118 may be formed from metals, polymers, metal alloys, combinations thereof, and other substantially rigid materials that can be used for vacuum insulated structures within appliances. As illustrated, holes 140 are defined by the wrapper 18 and the liner 118 to allow electrical wiring and other typical appliance lines to pass through the holes 140. For purposes of this disclosure, the wrapper 18 is described in detail; however, the liner 118 can be similarly constructed insofar as the liner 118 and the wrapper 18 generally have a similar shape to form the insulated structure 114. The wrapper 18 defines top and bottom surfaces 142, 146, the rear planar surface 22, and the curved surface 26 as well as first and second sidewalls 150, 154 of the appliance cabinet 90. In general, the rear planar surface 22 corresponds to a rear wall 156 of the appliance cabinet 90. The curved surface 26 and a lower portion 158 of the rear panel 106 at least partially define the machine compartment 30, such that machine components can be positioned beneath the rear planar surface 22 and curved surface 26 of the wrapper 18 within the machine compartment 30. Typically, the insulated structure 114, and consequently the wrapper 18, is concealed by the outer casing 94 of the appliance 10. Accordingly, the rear planar surface 22 of the wrapper 18 generally corresponds to the rear panel 106 of the appliance cabinet 90.

Figure 3:
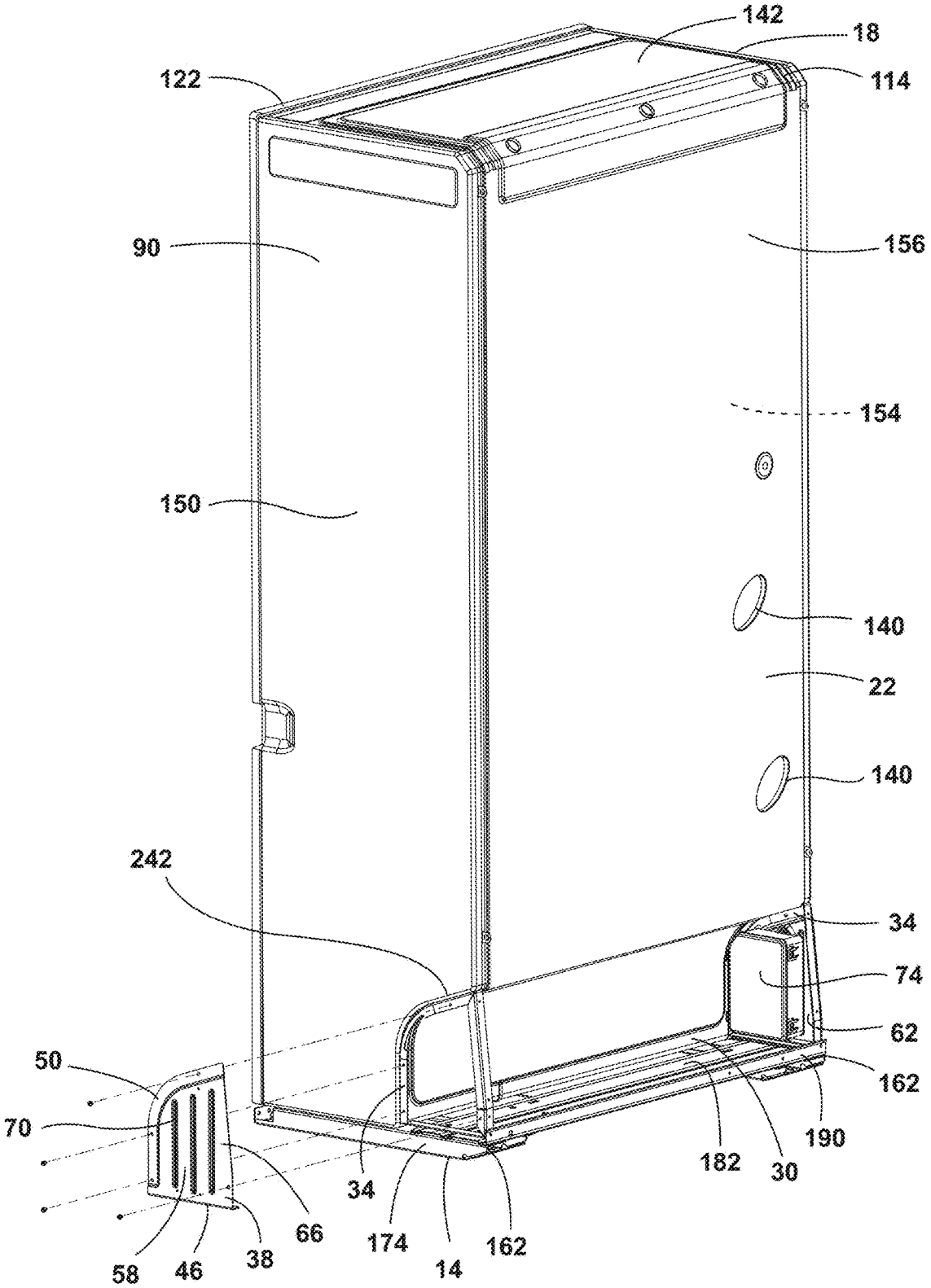
FIG. 3 is a partial exploded side perspective view of an insulated structure with a side access panel of the present disclosure.
Figure 4:
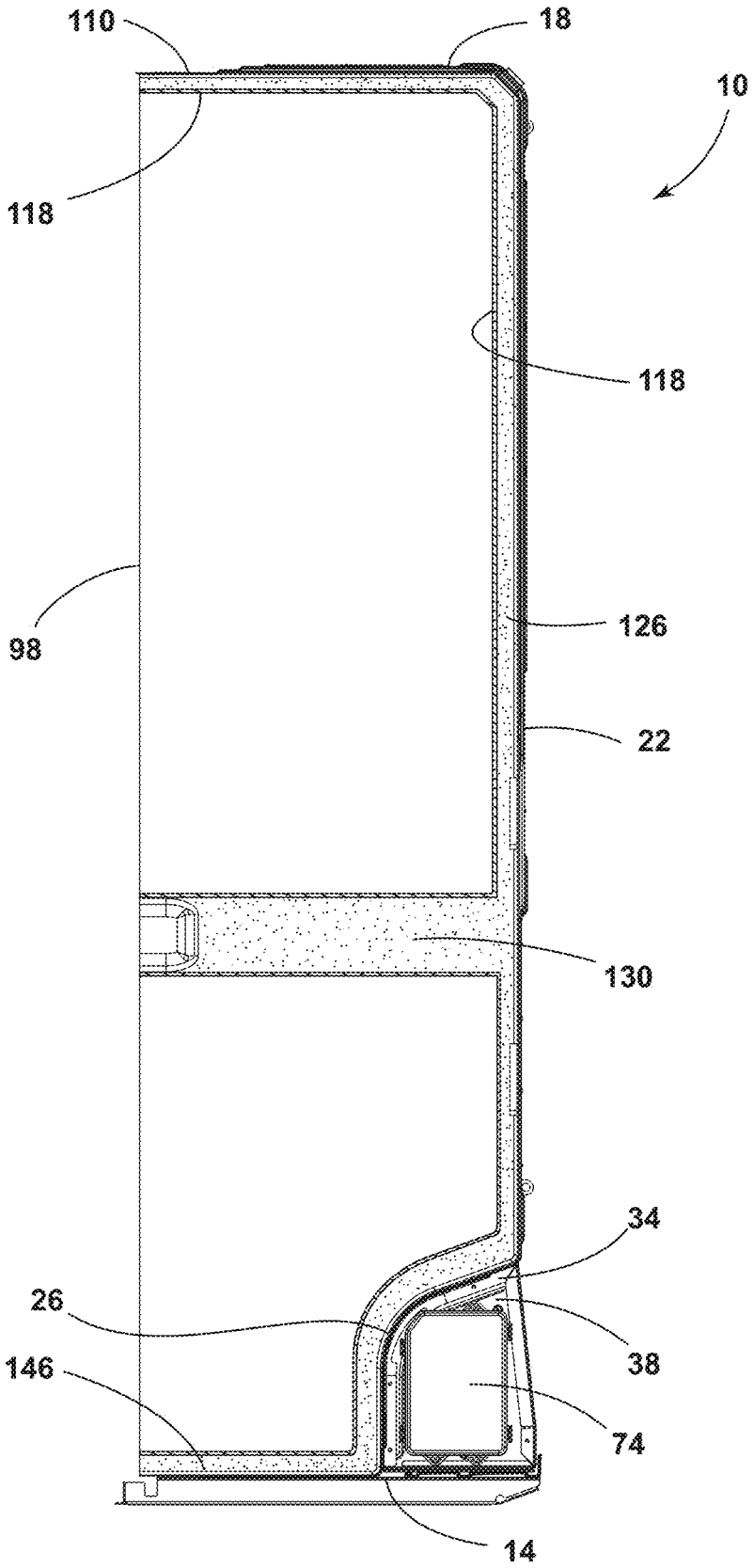
FIG. 4 is a side cross-sectional view of the insulated structure of FIG. 3.
Figure 5:
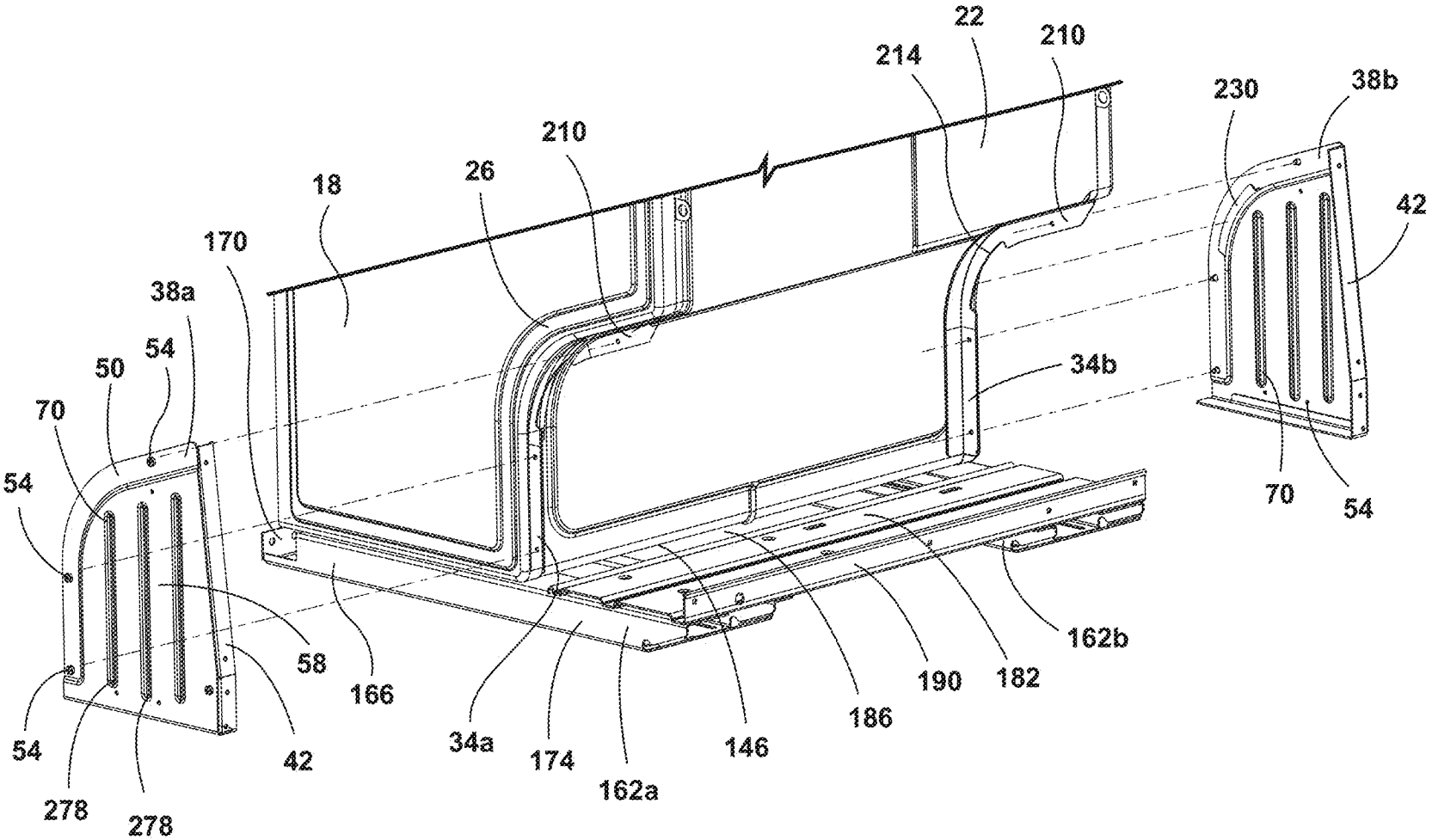
FIG. 5 is an exploded partial rear perspective view of an appliance of the present disclosure with side access panels and attachment features detached.
Figure 6:
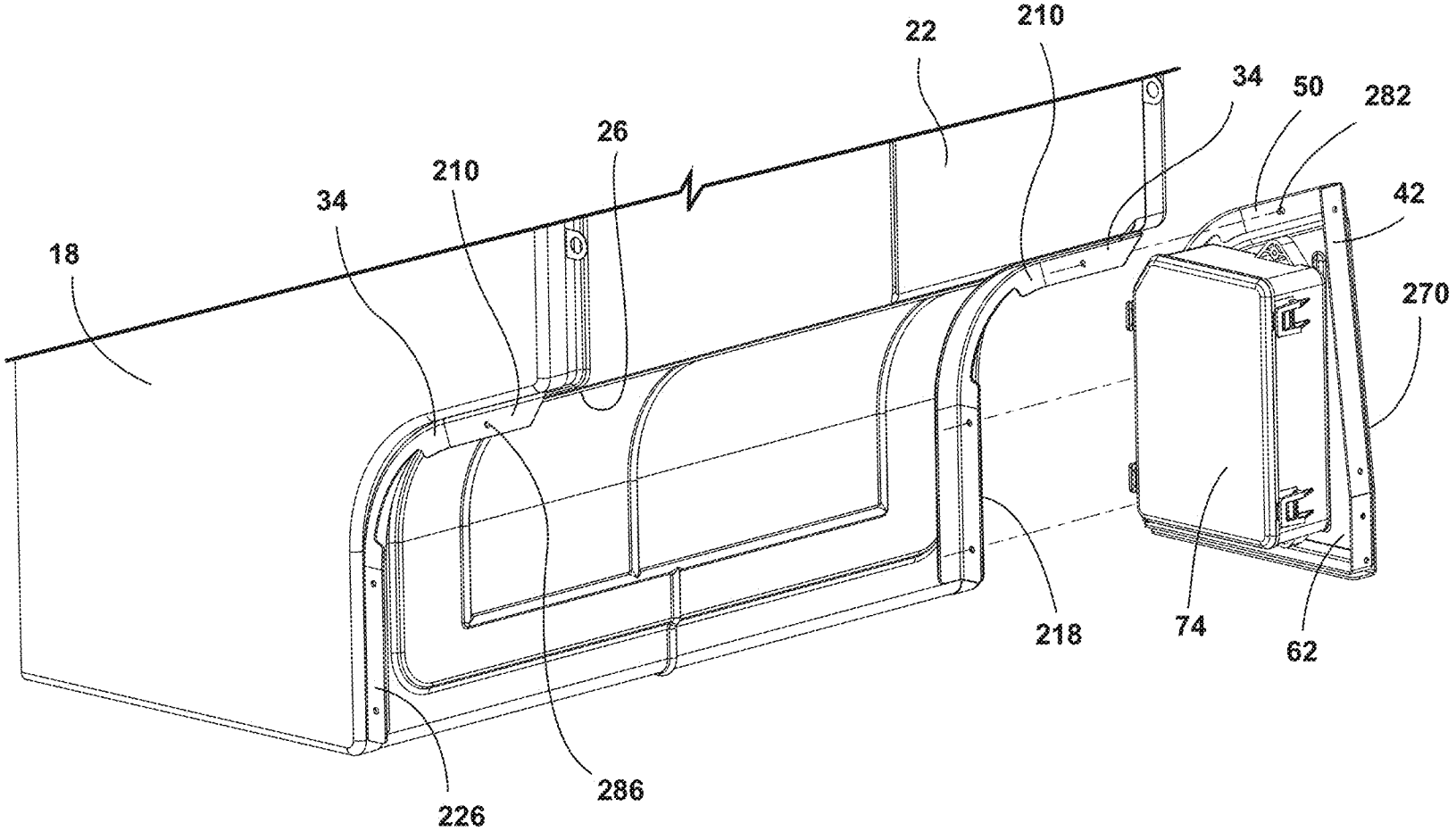
FIG. 6 is a partial rear perspective view of an appliance of the present disclosure with a controller removed.

Referring to FIGS. 3, 5, and 6, the wrapper 18 is positioned on and coupled to the base 14 to structurally support the appliance 10 (FIG. 1). In addition, the outer casing 94 (FIG. 1) of the appliance 10 (FIG. 1) is typically coupled to the base 14 to cover the insulated structure 114. The base 14 may be formed from metal, plastic, or other materials known to provide structural base support for the appliance 10 (FIG. 1). The base 14 may be a single piece of material extending across the bottom surface 146 of the wrapper 18. Additionally or alternatively, the base 14 may be rails positioned proximate to the first and second sidewalls 150, 154 of the appliance cabinet 90 and coupled to the bottom surface 146 of the wrapper 18. In either construction, the base 14 at least partially extends beyond the curved surface 26 of the wrapper 18 to lie substantially perpendicular with the rear planar surface 22 of the wrapper 18. In addition to the curved surface 26 of the wrapper 18, the machine compartment 30 is further defined by the base 14.

As illustrated in FIGS. 2 and 3, the base 14 includes a first rail 162*a* and a second rail 162*b*, which may be collectively referred to as base rails 162. A forward portion 166 of the base rails 162 includes a coupling extension 170 configured to couple to the outer casing 94 (FIG. 1) of the cabinet 90 to cover the insulated structure 114. As mentioned above, the rear portions 174 of the base rails 162 are generally disposed beneath the curved surface 26 of the wrapper 18, such that the rear portions 174 of the base rails 162 further define the machine compartment 30. A support plate 182 configured to support the machine components within the machine compartment 30 can be positioned over and coupled to the rear portion 174 of the base rails 162 to define a gap 186 therebetween. The gap 186 may provide passage for electrical wiring. For example, the controller 74 is positioned within the machine compartment 30 and may contain electrical wiring that may extend through the gap 186 beneath the wrapper 18. Additionally or alternatively, when the appliance 10 is a refrigerator and/or freezer, water lines connected to the appliance 10 may pass through the gap 186 defined by the base rails 162 and the support plate 182.

With further reference to FIGS. 3, 5, and 6, a lip 190 of the support plate 182 extends upwardly toward the rear planar surface 22 of the wrapper 18, such that the lip 190 and the rear panel 106 of the outer casing 94 at least partially enclose the machine compartment 30. The at least partial closure of the machine compartment 30 by the lip 190 and the rear panel 106 (FIG. 2) of the outer casing 94 (FIG. 2) minimizes access to the machine components within the machine compartment 30. Typically, the machine compartment 30 is entirely covered by the rear panel 106 (FIG. 2) and the lip 190. Accordingly, servicing of the machine components in conventional appliances results in the removal of the rear panel 106 (FIG. 2) and at least the movement of the appliance 10 (FIG. 2) to access the machine compartment 30 from a rear orientation of the appliance 10 (FIG. 2). To improve accessibility to the machine compartment 30, the side access panel 38 is removably coupled to the appliance 10 at the attachment feature 34 to provide access into the machine compartment 30, discussed in further detail below.

Figure 7:
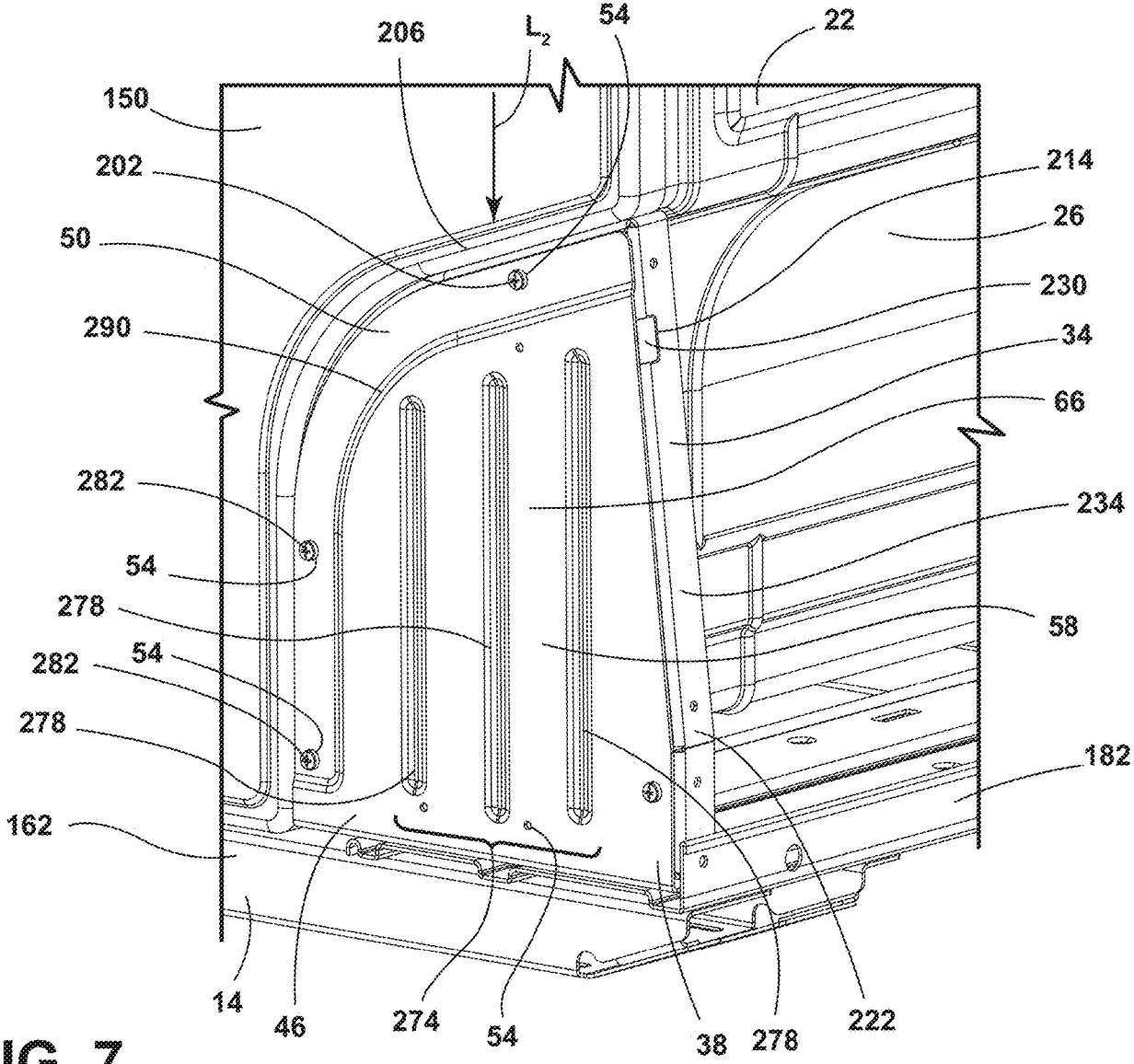
FIG. 7 is an enlarged partial rear perspective view of an appliance with a side access panel of the present disclosure.
Figure 9:
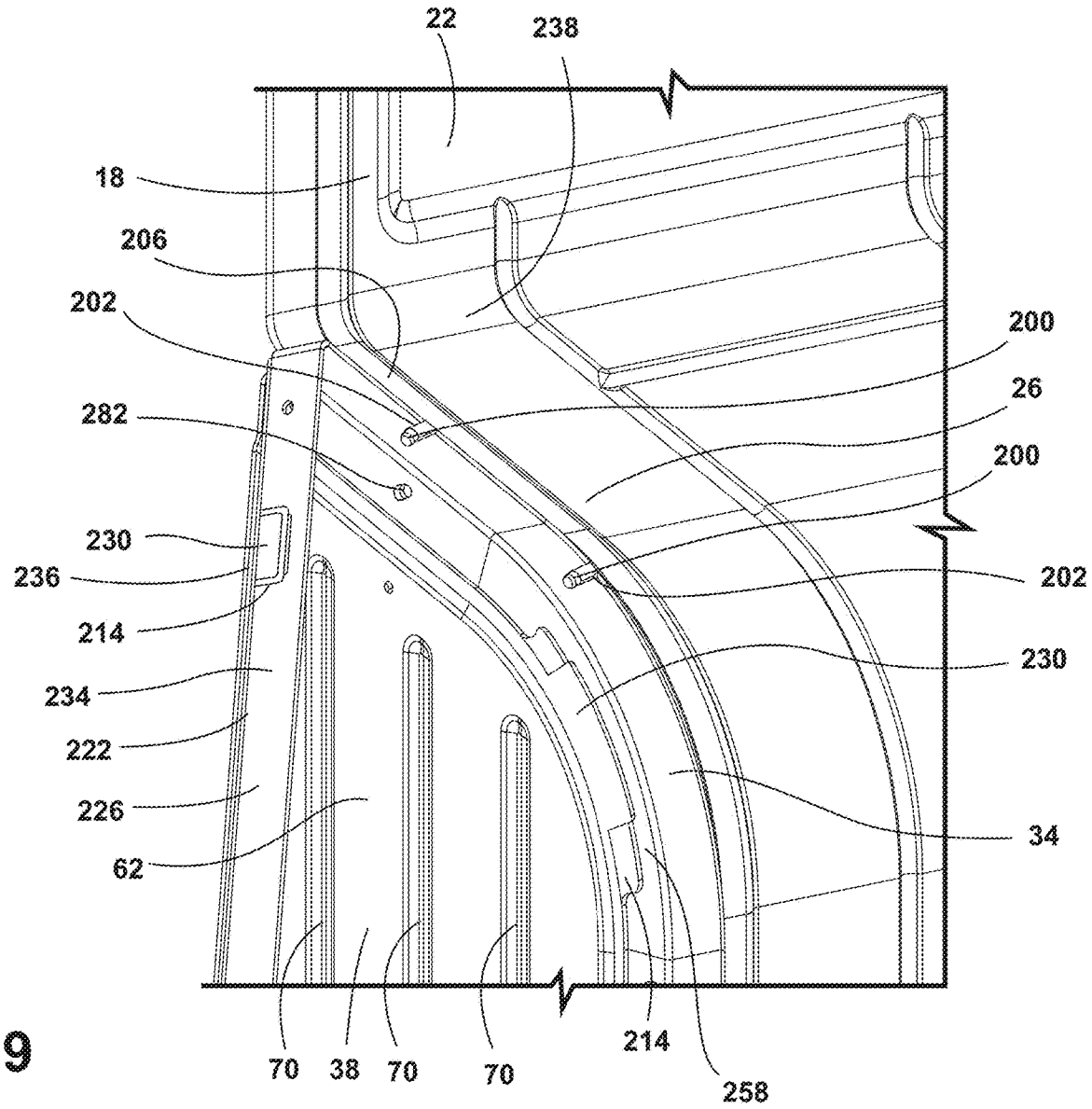
FIG. 9 is a partial top perspective view of an interior surface of a side access panel and an attachment feature of the present disclosure.

Referring to FIGS. 5, 7, and 9, the attachment feature 34 is configured to removably couple the side access panel 38 to the curved surface 26, such that as the attachment feature 34 extends along the curved surface 26 of the wrapper 18 as does the side access panel 38. The curved surface 26 of the wrapper 18 defines projections 200 that outwardly extend toward the machine compartment 30. The attachment feature 34 is coupled to the wrapper 18 at the curved surface 26 by coupling features 202 which couple to the projections 200 defined by the curved surface 26. The coupling features 202 of the attachment feature 34 may snap-fit with the projections 200 so the attachment feature 34 may be removed from the curved surface 26. Accordingly, when the side access panel 38 is removed, the attachment feature 34 may also be removed to provide additional access into the machine compartment 30. Additionally or alternatively, the attachment feature 34 may be welded to the wrapper 18 so that, while the side access panel 38 is removable, the attachment features 34 are securely coupled to the wrapper 18. In general, the attachment features 34 extend along and are disposed upon a peripheral edge 206 of the curved surface 26, such that the attachment feature 34 is operably coupled to the edge 206 of the curved surface 26.

As illustrated in FIG. 6, the attachment feature 34 is a bracket 210 that extends along the peripheral edge 206 of the curved surface 26. It is generally contemplated that the bracket 210 at least partially defines a substantially similar shape as the curved surface 26 of the wrapper 18, such that the bracket 210 has a generally arched shape that follows the curvature of the curved surface 26. In addition, when the attachment feature 34 is in the bracket 210 configuration, the side access panel 38 is coupled to the attachment feature 34 at the arcuate portion 50 of the side access panel 38. The remainder of the side access panel 38 is coupled to the base 14 of the appliance 10. Thus, the side access panel 38 may be removed from the attachment feature 34 and the base 14 to provide selective access into the machine compartment 30.

Figure 8:
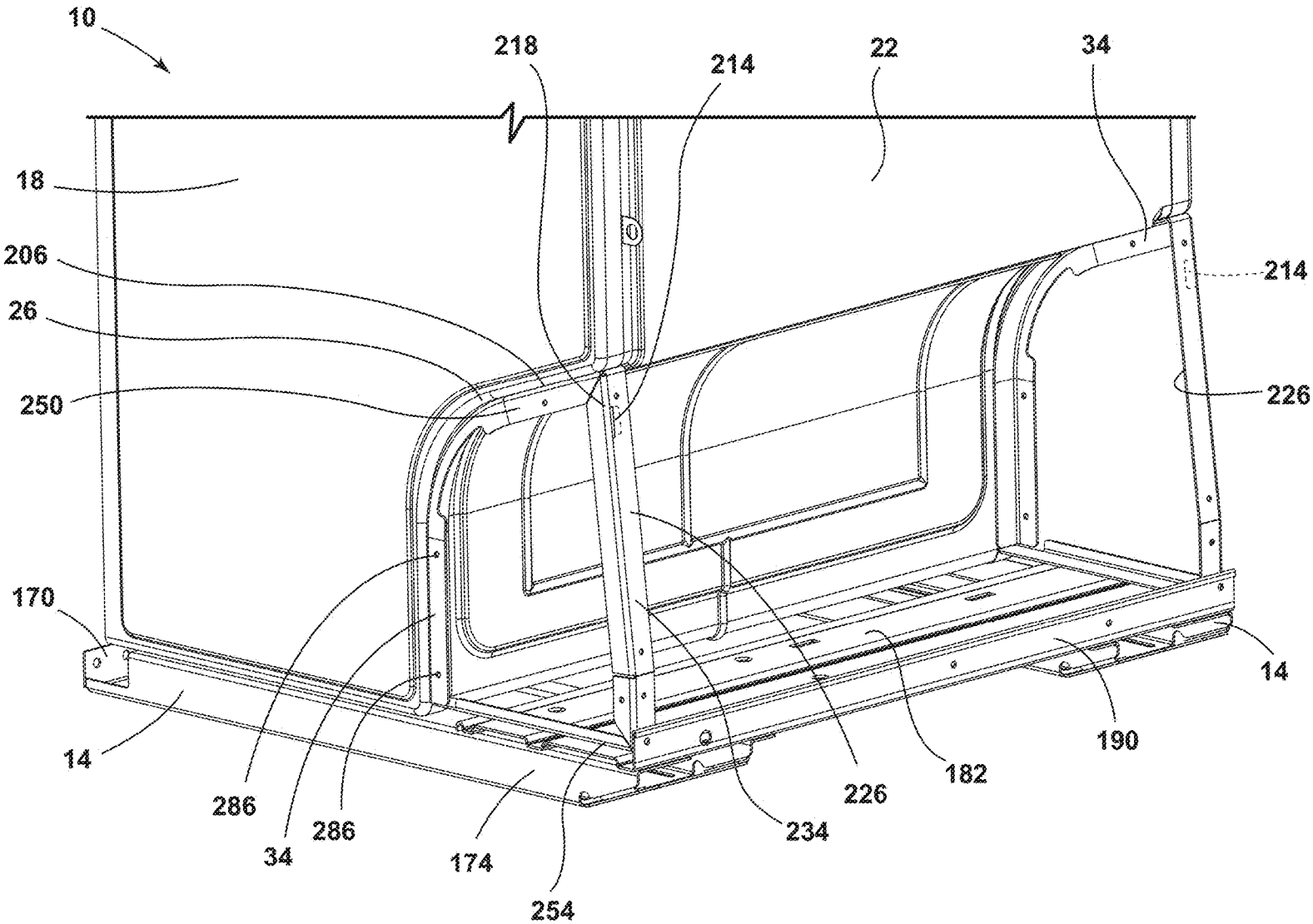
FIG. 8 is a partial rear perspective view of a wrapper and frames for an appliance of the present disclosure.

Referring to FIGS. 7-10, the attachment feature 34 includes retention slots 214 defined along a perimeter 218 of the attachment feature 34, discussed in further detail below. As illustrated in FIG. 8, the attachment feature 34 defines a frame 222 that extends along the curved surface 26 of the wrapper 18 and is adjacent to the lip 190 of the support plate 182 to generally define a D-frame construction. It is generally contemplated that the frame 222 defines flanges 226 that extend inward toward the machine compartment 30 in which the retention slots 214 may be defined. The side access panel 38 has retention tabs 230 that may inwardly extend from the central body 58 toward the machine compartment 30 and removably couple to the attachment features 34 via the retention slots 214. The retention slots 214 may be defined in a reinforcement segment 234 of the frame 222 so the side access panel 38 may couple to the retention slots 214 defined therein. As illustrated in FIG. 7, the retention tabs 230 of the side access panel 38 are disposed along an outer edge 236 of the side access panel 38. In such construction, the retention tabs 230 are configured to couple to the retention slots 214 defined within the reinforcement segment 234 of the attachment feature 34. As mentioned above, it is generally contemplated that the brim 42 may be defined as the retention tabs 230 that extend toward the machine compartment 30 from the outer edge 236 of the side access panel 38.

The frame 222 can at least partially provide additional structural support for the wrapper 18. For example, the reinforcement segment 234 of the frame 222 lies in a similar plane as the rear planar surface 22 of the wrapper 18, such that the reinforcement segment 234 of the frame 222 at least partially supports the wrapper 18 as an extension of the rear planar surface 22. In providing additional structural support, the frame 222 is coupled to the base 14 and may generally brace against an upper portion 238 of the curved surface 26 to further support a rear section 242 of the wrapper 18.

Figure 10:
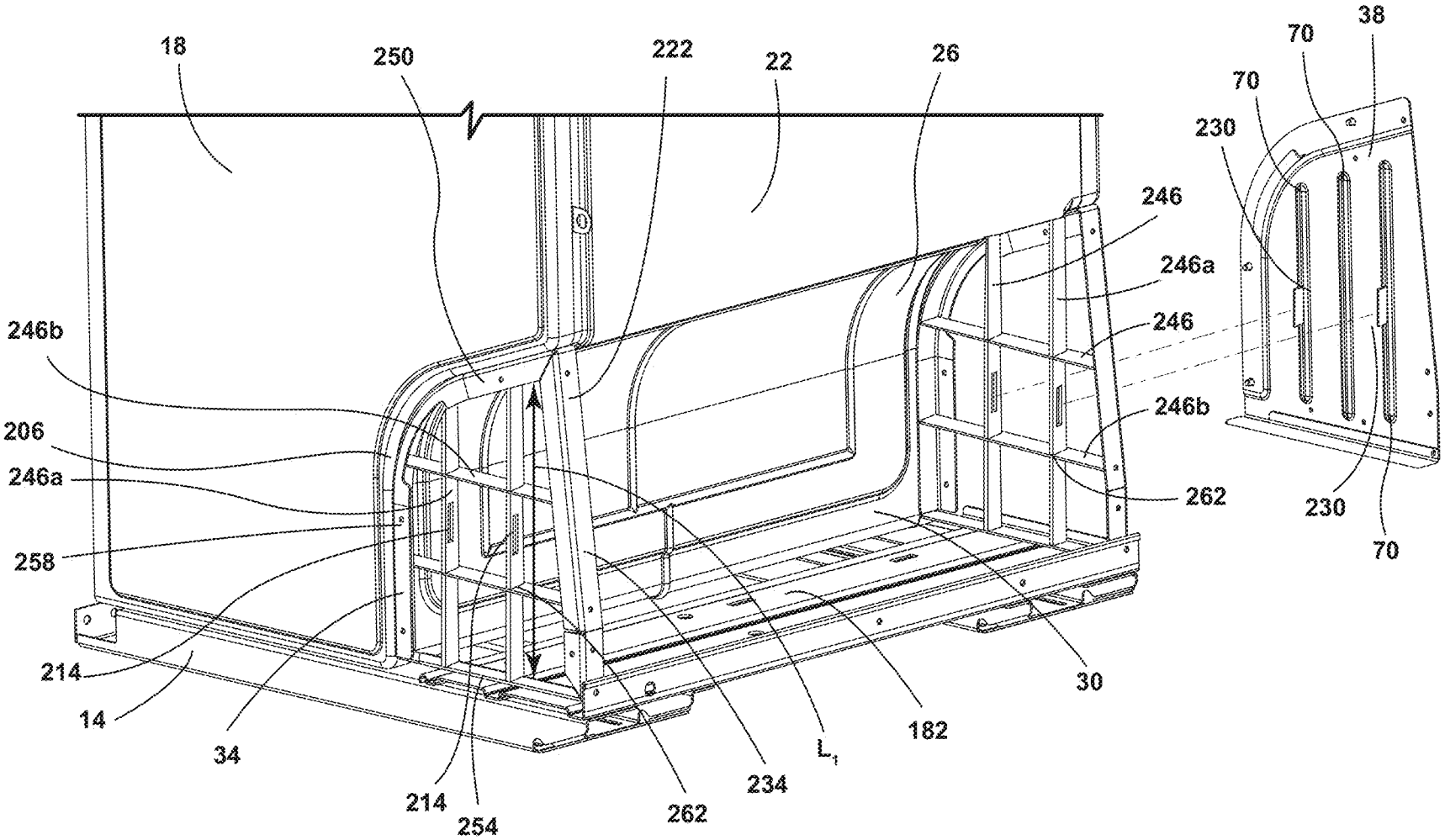
FIG. 10 is a partial exploded view of an attachment feature of the present disclosure that has a lattice structure.

With further reference to FIGS. 7-10, supports 246 may extend from a top 250 of the frame 222 to a bottom 254 of the frame 222. The supports 246 may also extend from an arcuate edge 258 of the frame 222 to the reinforcement segment 234 of the frame 222 to generally define a lattice structure 262 that has vertical and horizontal supports **246*a*, 246*b*. It is generally contemplated that the vertical supports 246*a* of the frame 222 may alternatively define the retention slots 214, such that the side access panel 38 may couple to the retention slots 214 defined in the vertical supports 246*a*. The side access panel 38 may be coupled to the vertical supports 246*a* of the frame 222 of the attachment feature 34. As illustrated in FIG. 10, the vertical supports 246*a* define the retention slots 214 along a length $L_1$ of the vertical supports 246*a*. The support ribs 70 defined by the central body 58 of the side access panel 38 may project inward toward the machine compartment 30 and can be coupled to the retention slots 214 defined by the vertical supports 246*a* of the attachment feature 34. By way of example, not limitation, the support ribs 70 can define the retention tabs 230 that extend through the retention slots 214 to removably couple the side access panel 38 to the attachment feature 34**.

A grasping portion 274 may be defined on the exterior surface 66 of the central body 58 by defined grooves 278 that correspond with the support ribs 70 on the interior surface 62 of the central body 58. The grooves 278 identify the support ribs 70 so a user can grasp the grooves 278 to remove the side access panel 38 from the attachment feature 34. While the side access panel 38 may be coupled to the attachment feature 34 by the retention slots 214 and the retention tabs 230, the side access panel 38 may also be coupled to the attachment feature 34 via fasteners 282. The fasteners 282 extend through the apertures 54 defined by the side access panel 38 and coupled to the attachment feature 34 through openings 286. The use of both the retention slots 214 and retention tabs 230, in addition to the fasteners 282, securely couples the side access panel 38 to the wrapper 18 while maintaining the removability of the side access panel 38 from the attachment feature 34 to provide access into the machine compartment 30. Additional apertures 54 may be defined by the central body 58 of the side access panel 38 so the controller 74 may be coupled to the interior surface 62 of the side access panel 38 by additional fasteners 282. Additionally or alternatively, the controller 74 may be coupled to the supports 246 of the frame 222.

With further reference to FIGS. 7-10, when the side access panel 38 is coupled to the attachment feature 34 via the retention tabs 230, the side access panel 38 may be easily removed from the attachment feature 34 such that the side access panel 38 provides selective access to the machine compartment 30 from the side of the appliance 10. Similar to the support provided by the frame 222 of the attachment feature 34, the side access panel 38 further includes an arcuate support rib 290 positioned between an edge of the arcuate portion 50 of the side access panel 38 and the central body 58. The arcuate support rib 290 may absorb and disperse a load $L_2$ that may be placed upon the side access panel 38 when coupled to the wrapper 18. It is generally contemplated that the arcuate support rib 290 deflects a greater amount of the load $L_2$ placed upon the side access panel 38 from the wrapper 18 when the attachment feature 34 is in the bracket 210 (FIG. 6) configuration. It is understood that while the side access panel 38 may provide load $L_2$ bearing support it is minimal with respect to other features described herein, such as the base 14.

With reference again to FIGS. 1-10, it is also contemplated that the side access panel 38 may include first and second side access panels 38*a*, 38*b* that are coupled to first and second attachment features 34*a*, 34*b*. Accordingly, the first attachment feature 34*a* removably couples the first side access panel 38*a* to the first sidewall 150, and the second attachment feature 34*b* removably couples the second side access panel 38*b* to the second sidewall 154. While described herein that the attachment feature 34 is coupled to the wrapper 18, it is also contemplated that the attachment feature 34 may be coupled to the at least one of the side panels 98, 102 of the outer casing 94. In such configuration, the curved surface 26 may be defined by the side panels 98, 102, such that the arcuate edge 258 of the attachment feature 34 is operably coupled to the curved surface 26 defined by the first and second side panels 98, 102 of the outer casing 94.

While the side access panel 38 provides selective access to machine compartment 30 through the sidewall of the appliance cabinet 90, it also provides a cost-effective way of forming the insulated structure 114, as the side access panel 38 is separate from the insulating structure 114 minimizing the overall cost of production of the appliance 10. In conventional insulating structures, the sides of the wrapper 18 extend from the top surface 142 to the bottom surface 146 to define a generally rectangular shape. Thus, conventional insulated structures utilize insulated materials in greater proportion than the insulated structure 114 described herein. Accordingly, by incorporating the side access panel 38, the cost of production is minimized as fewer insulation materials 130 are used in the side panels 98, 102 of the insulated structure 114. Therefore, the side access panel 38 provides both minimized cost in addition to selective access into the machine compartment 30.

The invention disclosed herein is further summarized in the following paragraphs and is further characterized by combinations of any and all of the various aspects described therein.

According to one aspect of the present disclosure, an appliance includes sidewalls. A curved surface is coupled to the sidewalls to define a machine compartment. An attachment feature is operably coupled to the curved surface proximate the sidewalls. A selectively removable side access panel is removably coupled to the attachment feature to define at least one access point to the machine compartment, and a controller is operably coupled to an interior surface of the selectively removable side access panel.

According to another aspect, a side access panel includes an arcuate portion that defines apertures and is operably coupled to an attachment feature.

According to still another aspect, a selectively removable side access panel includes a central body that defines support ribs.

According to yet another aspect, an attachment feature includes vertical supports and horizontal supports to define a lattice structure.

According to another aspect, an attachment feature defines a retention slot, and a selectively removable side access panel includes a retention tab that is selectively disposed within the retention slot.

According to yet another aspect, an attachment feature includes an arcuate edge that is operably coupled to a peripheral edge of a curved surface via projections.

According to still another aspect, an attachment feature is selectively removable from a curved surface via a snap-fit configuration that is defined with projections.

According to another aspect of the present disclosure, an appliance cabinet includes a wrapper that has sidewalls and define a machine compartment. An attachment feature is operably coupled to the wrapper proximate the sidewalls. The attachment feature includes horizontal supports and vertical supports that define a lattice structure of the attachment feature, and a selectively removable side access panel is removably coupled to the sidewalls to define at least one access point to the machine compartment.

According to another aspect, an attachment feature includes a frame that has a top and a bottom, and vertical supports are operably coupled to the top and the bottom of the frame.

According to yet another aspect, vertical supports define retention slots, and a selectively removable side access panel includes retention tabs that are selectively disposed within the retention slots of the vertical supports.

According to still another aspect, an attachment feature includes an arcuate edge that defines a retention slot, and a selectively removable side access panel includes a retention tab that is selectively disposed within the retention slot of the arcuate edge.

According to another aspect, an attachment feature is selectively removable from a wrapper to further define at least one access point to a machine compartment.

According to still another aspect, a selectively removable side access panel defines grooves along an external surface, and the grooves define a grasping portion of a selectively removable side access panel.

According to yet another aspect, a selectively removable side access panel includes support ribs along an internal surface of the selectively removable side access panel that further define grooves on an external surface.

According to yet another aspect of the present disclosure, an attachment feature for an appliance cabinet includes a frame that has a top and a bottom. A non-linear edge extends between the top and the bottom of the frame. A reinforcement segment extends between the top and the bottom of the frame on an opposing side from the non-linear edge. Vertical supports are positioned between the non-linear edge and the reinforcement segment and are operably coupled to the top and the bottom of the frame.

According to another aspect, vertical supports define slots configured to receive retention tabs of a side access panel.

According to yet another aspect, a side access panel is selectively removable from vertical supports to provide a single access point to a machine compartment.

According to still another aspect, horizontal supports are operably coupled to each of the vertical supports, the non-linear edge, and the reinforcement segment.

According to another aspect, horizontal supports and vertical supports define a lattice structure.

According to another aspect, a frame includes flanges that define retention slots configured to removably couple a side access panel is operably coupled to the flanges via the retention slots.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigerating appliance, comprising:

a refrigerating cabinet having an outer wrapper;

a machine compartment disposed proximate a rear bottom of the refrigerating cabinet, the machine compartment defined by selectively removable side panels, an inner curved surface of the outer wrapper, and a bottom support plate;

a controller disposed within the machine compartment;

reinforcement segments extending from a planar extent of the outer wrapper to a lip of the bottom support plate; and an independent lattice structure adjacent an interior surface of at least one of the selectively removable side panels.

2. The refrigerating appliance of claim 1, wherein an attachment feature is operably coupled to the inner curved surface proximate the selectively removable side panels.

3. The refrigerating appliance of claim 1, wherein the selectively removable side access panels include an arcuate portion defining apertures.

4. The refrigerating appliance of claim 1, wherein the selectively removable side access panels include support ribs.

5. The refrigerating appliance of claim 2, wherein the attachment feature includes vertical supports and horizontal supports to define a lattice structure.

6. The refrigerating appliance of claim 2, wherein the attachment feature defines a retention slot, and wherein the selectively removable side access panels include a retention tab selectively disposed within the retention slot.

7. The refrigerating appliance of claim 2, wherein the attachment feature includes an arcuate edge operably coupled to a peripheral edge of the inner curved surface via projections.

8. An appliance cabinet, comprising:

an outer wrapper enclosing an inner liner, the outer wrapper defining a machine compartment;

first and second support members extending from a rear most portion of the outer wrapper to the machine compartment;

first and second selectively removable side access panels removably coupled to the outer wrapper, each of the first and second selectively removable side access panels including a body with support ribs, an arcuate offset flange, and a linear flange that extends orthogonally from the body;

an attachment feature that includes a frame having a top and a bottom; and vertical supports that are operably coupled to the top and the bottom of the frame, wherein the vertical supports define retention slots, and wherein each of the first and second selectively removable side access panels include retention tabs selectively disposed within the retention slots.

9. The appliance cabinet of claim 8, wherein the support ribs are linear.

10. The appliance cabinet of claim 8, wherein the body of each of the first and second selectively removable side access panels includes a bottom flange that engages a lower support plate disposed below the machine compartment.

11. The appliance cabinet of claim 8, wherein each of the first and second selectively removable side access panels defines grooves along an external surface, and wherein the grooves define a grasping portion of the respective selectively removable side access panel.

12. An appliance cabinet, comprising:

an outer wrapper;

a base including a first rail and a second rail, wherein the first rail and the second rail extend beyond a rear wall of the outer wrapper;

a machine compartment disposed between the outer wrapper and the first and second rails;

a first side access panel disposed between the outer wrapper and the first rail;

a second side access panel disposed between the outer wrapper and the second rail; and a lattice having horizontal supports operably coupled to vertical supports.

13. The appliance cabinet of claim 12, wherein the horizontal supports and the vertical supports are adjacent the first and second side access panels.

* * * * *